United States Patent [19]

Ulveling et al.

[11] 4,437,796

[45] Mar. 20, 1984

[54] PNEUMATIC TRANSPORT PROCEDURE AND APPARATUS

[75] Inventors: Leon Ulveling, Howald; Edouard Legille, Luxembourg; Jean Boever, Bergem, all of Luxembourg

[73] Assignee: Paul Wurth S.A., Luxembourg, Luxembourg

[21] Appl. No.: 158,612

[22] Filed: Jun. 11, 1980

[30] Foreign Application Priority Data

Jun. 15, 1980 [LU] Luxembourg ..... 81388

[51] Int. Cl.[3] ..... B65G 53/66

[52] U.S. Cl. ..... 406/25; 266/176; 406/32; 406/124

[58] Field of Search ..... 406/10, 23, 24, 25, 406/32, 124, 125, 126, 169, 175; 414/199, 200, 217, 218, 221; 266/176, 182, 216

[56] References Cited

U.S. PATENT DOCUMENTS

| | | | |
|---|---|---|---|
| 3,167,421 | 1/1965 | Pfeiffer et al. | 266/176 X |
| 3,197,304 | 7/1965 | Agarwal | 266/176 X |
| 3,355,221 | 11/1967 | Reuter | 406/124 X |
| 3,689,045 | 9/1972 | Coulter et al. | 406/24 X |
| 3,994,701 | 11/1976 | Schweimanns | 406/124 X |

FOREIGN PATENT DOCUMENTS

| | | | |
|---|---|---|---|
| 995130 | 6/1965 | United Kingdom | 406/169 |

*Primary Examiner*—Jeffrey V. Nase

*Attorney, Agent, or Firm*—Fishman & Dionne

[57] ABSTRACT

A pulverized combustible material or ore is transported from a storage container, at atmospheric pressure, to the interior of a pressurized shaft furnace via three intermediate receptacles. The material is weighed in the first receptacle, pneumatically transported to the second receptacle, the second receptacle pressurized and the material transmitted under pressure to the third receptacle which is maintained at a pressure which is higher than the furnace pressure.

21 Claims, 1 Drawing Figure

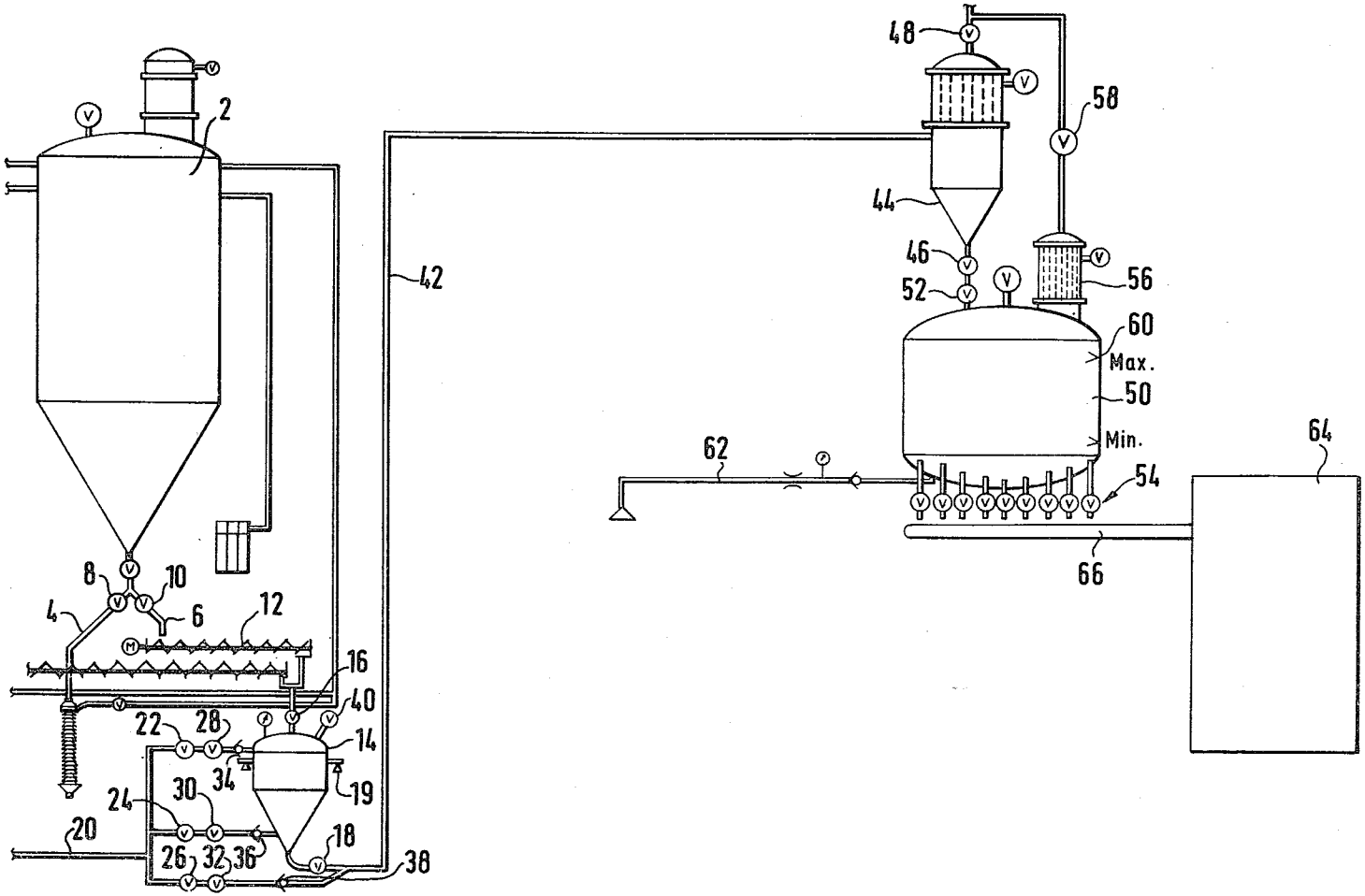
64
66
54
Min.
50
Max.
60
56
58
48
44
46
52
62
42
38
2
16
40
14
19
18
12
6
10
8
4
28
34
22
30
26
32
36
24
20

PNEUMATIC TRANSPORT PROCEDURE AND APPARATUS

BACKGROUND OF THE INVENTION (1) Field of the Invention

The invention relates to a pneumatic proportioning and transport procedure for solids between an atmospherically pressurized storage container and a pressurized chamber, as well as apparatus for the implementation of such a procedure.

(2) Brief Description of the Prior Art

Although it is not restricted to this, the present invention concerns the handling of pulverized solid materials in the iron and steel industry such as lignite powder with a view to injection thereof into blast furnaces. The present invention also has applicability to the transport of powdered ore for injection into a direct reduction installation reactor. Accordingly, the invention shall be described by way of illustration in reference to such iron and steel applications.

The utilization of lignite as a fuel for the maintenance of the reduction process in blast furnaces is a very recent technique, the mastering of which is of particular interest to the extent that it allows oil products to be replaced by lignite which is an inexpensive product of which there are still large reserves. Unfortunately, this technique has remained at the theoretical stage or, at the most, the experimental stage. The reason for previous lack of commercial application of the technique in question is precisely that, to date, the technical means necessary for the injection of large and proportioned quantities into pressurized chambers, such as a blast furnace, have not been available.

The problem of the transport of pulverized coal and ore in the case of direct reduction plants, although being slightly different, is nevertheless comparable to the extent that, while such plants already exist, costly and cumbersome mechanical transport systems must be used for horizontal and vertical transport and it has not yet been possible to benefit from the advantages offered by pneumatic transport systems which are well known in themselves. Once again the reason is that it is a question of injecting large quantities into a pressurized receptacle in a controlled manner and in a proportioned quantity. Previously available pneumatic systems do not comply simultaneously with all these criteria, a condition which is, however, sine qua non for implementation on an industrial level in the applications concerned.

SUMMARY OF THE INVENTION

Consequently, the objective of this invention is to overcome the above-briefly discussed and other deficiencies of the prior art and provide a new procedure which allows controlled and proportioned counter-pressure injection of a pulverized solid material into a chamber, as well as apparatus for the implementation of such a procedure.

To achieve the above-mentioned general objective, this invention comprises a pneumatic proportioning and transport procedure for conveying pulverized solids between an atmospherically pressurized storage container and a pressurized chamber characterised in that the solid material is extracted from the storage container and is introduced into an atmospherically pressurized proportioning receptacle until this receptacle contains a predetermined quantity of solid, the contents of this receptacle being continually measured during the course of filling. The storage container is then isolated from the proportioning receptacle and the proportioning receptacle is pressurized. Next, communication is established between the pressurized proportioning receptacle and an intermediate receptacle which is, at the moment in question, atmospherically pressurized. The contents of the proportioning receptacle are thus transferred from the proportioning receptacle into the intermediate receptacle pneumatically and by means of a propulsion fluid having a pressure which is equal to the preliminary pressure in the proportioning receptacle. The proportioning receptacle is isolated from the intermediate receptacle when the contents of the proportioning receptacle have been fully transferred into the intermediate receptacle. The intermediate receptacle is then pressurized. While the proportioning receptacle is ventilated and its filling operation is recommenced. The contents of the pressurized intermediate receptacle are transferred from the intermediate receptacle into a feed tank in which a pressure is maintained, this pressure being at a level between the pressure in the chamber to which the solid material is to be delivered and the pressure in the intermediate receptacle. The solid material is extracted from this feed tank as required and conveyed to the interior of the chamber.

The propulsion fluid is preferably air with a temperature lower than 80° C. circulating at a speed of approx. 20 meters/second.

The solid material may be either lignite, ore, or coal dust in powdered form.

Apparatus for the implementation of the invention is characterised basically by a proportioning receptacle suspended by pressure pick-ups to measure continually the weight of the contents of this receptacle; an intermediate receptacle installed below the proportioning receptacle and a feed tank installed below the intermediate receptacle. A plurality of valves, the operation of which is coordinated, are associated with the said receptacles and the said tank to isolate them as required from other elements of the apparatus.

The intermediate receptacle and the feed tank are equipped with level probes to measure the contents thereof.

BRIEF DESCRIPTION OF THE DRAWING

Other features and characteristics will emerge from the detailed description to be presented below in relation to the single FIGURE which is a schematic diagram of apparatus in accordance with a preferred embodiment of this invention.

DESCRIPTION OF THE PREFERRED EMBODIMENT

The powdered material is stored in a storage container 2 into which it is conveyed directly by a transport mechanism such as a train or conveyor. While a single storage container is shown in the drawing, in general two such storage containers are provided in order to enable continuous operation.

The powdered material is evacuated from the bottom of the storage container 2 via a conduit 6 equipped with an automatic valve 10. A second conduit 4, equipped with an automatic valve 8, serves for emptying the storage container 2. The powdered material discharged from conduit 6 is received by a screw conveyor 12 and transported into a proportioning receptacle 14 equipped with two automatic valves 16 and 18 for isolation upwards or downwards respectively.

The proportioning receptacle 14 rests on several, e.g. three pressure pick-ups 19 designed to measure continually the weight of the proportioning receptacle 14 and more particularly the weight of its contents. This weight measuring system serves, as explained subsequently, for the automatic control of the apparatus. A pressurized air-feed conduit is indicated by reference numeral 20. If the pressure in the chamber 64 into which the powdered material is to be injected is 2.5 bars, for example a gas pressure of approx. 3.5 bars must be provided in conduit 20. Conduit 20 is divided into three branches which respectively have installed therein an automatic valve 22, 24 and 26, a manual valve 28, 30 and 32, and a non-return (check) valve 34, 36 and 38. The automatic valves 22, 24 and 26 are designed for the automatic regulation of the discharge of pressurized air as required, whilst the manual valves 28, 30 and 32 serve for an initial manual regulation, fixing the maximum pressure in each of the conduits. The proportioning receptacle 14 is also equipped with an automatic valve 40 for the venting of the receptacle.

The pulverized material is conveyed pneumatically from the proportioning receptacle 14 via a conduit 42 using as a propulsion fluid, pressurized air directly introduced into conduit 42 through valve 26. The conduit 42 conveys the powdered material into an intermediate receptacle 44. This receptacle, which is alternatively pressurized and atmospherically pressurized, also has associated therein two automatic valves 46 and 48 for isolation respectively from tank 50 and the ambient atmosphere. Below the intermediate receptacle 44, there may a feed tank 50 which is also be isolated upwards and downwards by automatic valves 52 and 54 respectively. A filtering device 56 is coupled to tank 50 and a self-regulating pressure valve 58 is connected to this filtering device. Valve 58 maintains a uniform pressure in the tank 50, e.g. a pressure of 3 bars when the initial pressure in conduit 20 is 3.5 bars. The tank 50 is also connected to a pressurized air conduit 62 designed to increase the pressure inside tank 50 when the said pressure falls below the pressure to which the self-regulating valve 58 is set.

Reference 66 indicates diagrammatically the transfer of the powdered material from tank 50 to the pressurized chamber 64. This chamber 64 may, for example, be the reactor of a direct reduction plant which is connected to two installations of the type described above, one being designed for the conveyance of coal powder and the other for iron ore powder.

Chamber 64 may also be a blast furnace in which case the installation described above could be employed for the injection of lignite into the furnace. In the latter case, the lignite will be extracted from tank 50 and propelled pneumatically to be injected into the blast tuyeres. Whilst, in the case of the transport of coal and iron ore powder, the transfer 66 may be formed by one single conduit, in the case of lignite a certain number of conduits must be provided in accordance with the number of tuyeres, preferably one conduit for every pair of blast tuyeres.

A method of utilisation of the apparatus described above for the injection of lignite into a blast furnace with a counter-pressure of 2.5 bars will now be described. By way of example, reference shall be made to a furnace equipped with a series of nineteen tuyeres, with an hourly consumption of 27 tons of lignite. For such an installation, two storage tanks 2 shall be provided with a capacity of 500 $m^3$ each.

At the beginning of the cycle, the valves 18, 22, 24 and 26 are closed, whilst valves 10, 16 and 40 are open. The lignite powder flows by gravity from tank 2 and is introduced by the screw transporter 12 into the proportioning receptacle 14. When the contents of the proportioning receptacle reaches the recorded/instructed weight, detected by pick-ups 19, a control signal is generated which stops the action of the screw transporter 12, closes the valves 16 and 40 and opens valves 18, 22 and 26. Valve 24, in principle, remains closed and will only be opened in the case of emergency to increase the degree of fluidity of the contents of the proportioning receptacle 14. Valve 22 controls the entry of pressurized air into the upper part of the proportioning receptacle 14 in order to encourage the flow of the lignite powder toward the bottom of this receptacle. The pressure of air admitted into the receptacle 14 is equal to that in the feed conduit 20, i.e. 3.5 bars.

Valve 18 will be governed automatically in accordance with the contents of the proportioning receptacle so that receptacle 14 is emptied in a pre-determined time. Valve 26 will be governed in accordance with valve 18 so as to have an optimal proportion between the lignite and the propelling air in conduit 42, this proportion generally being 100 kilos of solid material per kilo of fresh air.

Whilst the lignite is propelled pneumatically into the intermediate receptacle 44, this receptacle is atmospherically pressurized, i.e. the valve 48 is open. The speed of transport in conduit 42 is approx. 20 meters/second. This speed is determined in conformity with two criteria, that is to avoid deposits (lower limit: 18 meters/-second) and in accordance with safety considerations, i.e. to avoid a return of flames.

During the filling of receptacle 44, valve 48 remains open. When the contents of the proportioning receptacle 14 have been transferred into the intermediate receptacle 44, the valves 18, 22, 26 and 48 will be closed. It is preferable to operate in the chamber 44 with a pressure of 3.5 bars and for this purpose it is possible to delay the closing of valve 26 until a few moments after the closing of the other valves in order to inject a supplement of pressurized air into the receptacle 44 in order for the pressure in receptacle 44 to reach level of 3.5 bars. Instead of using the propelling fluid to produce the pressure required in chamber 44, a source of pressurized gas specially designed for this purpose can also be used, such as an inert gas such as nitrogen.

When the level of pulverized material in the feed tank 50 reaches a preset minimum as determined by level probes (not shown) which, in general, are gamma ray probes, the valves 46 and 52 are opened for the transfer of the contents of receptacle 44 into tank 50. This naturally means that the operation programme is such that the receptacle 44 must be full and pressurized before the said minimum level is reached in the tank 50.

The flow from receptacle 44 towards tank 50 is interrupted by the closure of valves 46 and 52 at the moment a present minimum level is reached in receptacle 44. This minimum level is also determined for example by means of a gamma ray probe.

Naturally, the filling operation of the proportioning receptacle 14 commences again immediately after the closure of valve 18 and after the receptacle has been ventilated by means of opening valve 40. The filling of proportioning receptacle 14 is, accordingly generally carried out in parallel with the filling of tank 50.

One of the important features of the above-described apparatus is that it allows an accurate control of the quantity of solid injected into the pressurized chamber 64. In view of the fact that the requirements in lignite are fixed in weight, it is necessary to effect a weight proportioning instead of a volumetric proportioning because the specific weight of the lignite or of other powdered materials is not constant. But, it is not possible to carry out a weighing of tank 50, with a view to proportioning, as this tank is constantly pressurized. On the other hand, receptacle 14, which is specially designed for this purpose, can be depressurized for the weighing and pressurized for the supplying. Consequently, the proportioning is carried out in conformity with the needs of chamber 64. The signals resulting from the weighing of the receptacle 14, in association with the signals emitted from the level probes, allow an automatic control of the various valves, in order to ensure an optimal sequence of the different successive operations. Thus, it may be seen that the present invention has achieved a compatibility between pneumatic transport and weight proportioning of the substances transported.

It must be emphasized that the values of the pressures quoted above are only given by way of example. If one operates with another pressure in chamber 64, it is evident that the operative pressures shall consequently be adapted.

Finally, it must be noted that the pressure of the pneumatic propulsion fluid in conduit 20 need not necessarily be greater than the pressure in chamber 64. This is only the case if this propulsion fluid also serves for the pressurization of chamber 44.

We claim:

1. A method for transferring a controlled quantity of pulverized material from a storage container at atmospheric pressure into a pressurized container, comprising the steps of:

delivering pulverized material from the storage container into a first receptacle;

continually measuring the weight of material delivered into the first receptacle and terminating the delivery of material from the storage container when a pre-selected quantity of the material is present in the first receptacle;

isolating the first receptacle from the storage container subsequent to termination of the delivery of pulverized material thereto;

introducing a pressurized gas to said first receptacle and coupling the discharge from said first receptacle to a source of pressurized gas to pneumatically transfer the contents of the first receptacle into a second receptacle during the isolation of the first receptacle from the storage container;

isolating the second receptacle from the first receptacle when the contents of the first receptacle have been transferred thereto;

pressurizing the second receptacle subsequent to the isolation thereof from the first receptacle;

causing the material in the pressurized second receptacle to flow into a feed chamber in which an intermediate pressure is maintained between the pressure in said second receptacle after pressurization thereof and the pressure in said pressurized container; and delivering the material from the feed chamber to a pressurized container.

2. The method of claim 1 wherein the second receptacle is at atmospheric pressure when the pulverized material is transferred thereto from the first receptacle.

3. The method of claim 1 further comprising the steps of:

venting the first receptacle when its contents have been transferred to the second receptacle; and delivering additional material from the storage container to the first receptacle subsequent to the venting of the first receptacle.

4. The method of claim 3 wherein the second receptacle is at atmospheric pressure when the pulverized material is transferred thereto from the first receptacle.

5. The method of claim 4 wherein the step of measuring the quantity of the first receptacle comprises:

continuously weighing the first receptacle as pulverized material is delivered thereto.

6. The method of claim 1 wherein the step of measuring the quantity in the first receptacle comprises:

continuously weighing the first receptacle as pulverized material is delivered thereto.

7. The method of claim 1 wherein the step of pneumatically transferring the contents of the first receptacle to the second receptacle comprises:

entraining the pulverized material in air at a temperature less than 80° C., the air being caused to flow at a speed of approximately 20 meters per second.

8. The method of claim 1 wherein the step of pressurizing the second receptacle comprises the step of:

coupling the second receptacle to the source of the pressurized gas employed to pneumatically transfer the contents of the first receptacle to the second receptacle.

9. The method of claim 1 further comprising the steps of:

monitoring the level of pulverized material in the feed chamber;

causing material to flow from the pressurized second receptacle to the feed chamber when the level of material in the feed chamber reaches a predetermined minimum;

monitoring the level of the pulverized material in the second receptacle; and terminating the flow of material from the second receptacle to the feed chamber when the level in the second receptacle reaches a preselected minimum.

10. The method of claim 1 further comprising the steps of:

monitoring the level of pulverized material in the feed chamber;

causing material to flow from the pressurized second receptacle to the feed chamber when the level of material in the feed chamber reaches a predetermined minimum; and terminating the flow of material from the second receptacle to the feed chamber when the level in the feed chamber reaches a preselected maximum.

11. The method of claim 1 wherein the pressurized container is a shaft furnace and wherein the material transferred thereto from storage at atmospheric pressure is combustible.

12. The method of claim 1 wherein the pressurized container is a shaft furnace and wherein the material transferred thereto from storage at atmospheric pressure is iron ore.

13. The method of claim 1 wherein the step of pneumatically transferring the contents of the first receptacle to the second receptacle comprises:

entraining the pulverized material in air.

14. The method of claim 13 wherein the step of pressurizing the second receptacle comprises the step of:

coupling the second receptacle to the source of the pressurized gas employed to pneumatically transfer the contents of the first receptacle to the second receptacle.

15. Apparatus for transferring pulverized material from storage at atmospheric pressure into a pressurized container comprising:

a first receptacle;

means for delivering pulverized material from storage into said first receptacle;

means for continually measuring the weight of material delivered into said first receptacle;

means for isolating the interior of said first receptacle from the ambient atmosphere when a predetermined quantity of material is present in said first receptacle, the delivery of material into said first receptacle being terminated prior to operation of said isolation means to isolate said first receptacle from the ambient environment;

first coupling means for selectively coupling the interior of said first receptacle to a cource of pressurized gas;

a second receptacle;

second coupling means for selectively coupling the interior of said first receptacle to the interior of said second receptacle;

means for delivering pressurized gas to said second coupling means for the pneumatic transfer of the pulverized material from said first receptacle to said second receptacle;

third coupling means for selectively establishing communication between the interior of said second receptacle and the ambient atmosphere;

a feed chamber;

means for pressurizing the interior of said second receptacle;

means for pressurizing the interior of said feed chamber to an intermediate pressure between the pressure in said second receptacle after pressurization and the pressure in said pressurized container;

fourth coupling means fo selectively establishing communication between the interior of said second receptacle and the interior of said feed chamber whereby material in said second receptacle may be transferred into said feed chamber when said second receptacle is pressurized and isolated from said first receptacle and the ambient atmosphere; and means for transferring pulverized material from said feed chamber into the pressurized container.

16. The apparatus of claim 15 wherein said means for pressurizing said second receptacle comprises:

means establishing communication between the interior of second receptacle and the source of pneumatic transfer gas.

17. The apparatus of claim 15 further comprising:

pressure regulator means for maintaining a pressure in said feed chamber which is higher than the pressure in the pressurized container.

18. The apparatus of claim 15 further comprising:

means for measuring the level of material in said feed chamber and for generating signals commensurate with a minimum level whereby said fourth communication establishing means may be controlled to insure that the quanity of material in the feed chamber does not fall below a predetermined level.

19. The apparatus of claim 15 wherein said continually measuring means comprises:

means for weighing said first receptacle.

20. The apparatus of claim 19 wherein said means for pressurizing said second receptacle comprises:

means establishing communication between the interior of second receptacle and the source of pneumatic transfer gas.

21. The apparatus of claim 20 further comprising:

means for measuring the level of material in said feed chamber and for generating signals commensurate with a minimum level whereby said fourth communication establishing means may be controlled to insure that the quantity of material in the feed chamber does not fall below a predetermined level.

* * * * *